United States Patent [19]

Koppers et al.

[11] 4,252,476

[45] Feb. 24, 1981

[54] HYDRAULICALLY OPERATED MINE PROP WITH SAFETY VALVE

[75] Inventors: Manfred Koppers, Duisburg; Peter Marr, Bochum, both of Fed. Rep. of Germany

[73] Assignee: Bochumer Eisenhütte Heintzmann GmbH & Co., Bochum, Fed. Rep. of Germany

[21] Appl. No.: 72,783

[22] Filed: Sep. 5, 1979

[30] Foreign Application Priority Data

Sep. 12, 1978 [ZA] South Africa ..... 78/5167

[51] Int. Cl.[3] ..... F21D 15/00

[52] U.S. Cl. ..... 405/290; 248/354 H; 137/529

[58] Field of Search ..... 405/288, 290, 291; 248/356, 354 H; 137/529, 538, 540; 91/468

[56] References Cited

U.S. PATENT DOCUMENTS

| | | | |
|---|---|---|---|
| 2,621,631 | 12/1952 | Dowty | 405/290 X |
| 2,695,764 | 11/1954 | Grebe | 248/356 |
| 2,912,001 | 11/1959 | Green | 137/516.29 |
| 3,557,826 | 1/1971 | Albrecht | 137/529 |
| 3,913,613 | 10/1975 | Kostjunin et al. | 137/529 X |
| 4,142,449 | 3/1979 | Koppers et al. | 248/354 H |

FOREIGN PATENT DOCUMENTS

| | | | |
|---|---|---|---|
| 453560 | 9/1936 | United Kingdom | 248/356 |
| 927765 | 6/1963 | United Kingdom | 248/354 H |

*Primary Examiner*—Dennis L. Taylor

*Attorney, Agent, or Firm*—Michael J. Striker

[57] ABSTRACT

A mine prop provided with an overpressure valve of large flow-through section which opens when excessive forces suddenly act on the prop to discharge pressure fluid from the interior of the prop. The overpressure valve comprises a hollow cylindrical housing forming at one end a valve seat communicating with the fluid-filled inner space of the prop and a valve member axially guided in the housing for movement between a closed position engaging the valve seat and an open position. The fluid-filled space of the prop communicates with channels leading to the outside of the prop. The valve member is normally maintained in the closed position by a gas pillow under high pretension confined in a pressure space delimited peripherally by the wall of the valve housing and at opposite ends respectively by the valve member and a plug fluid tightly mounted in and closing the other end of the housing. The valve member and the plug are both formed from metal and are both provided at facing ends with annular slender sealing lips of triangular cross-section tapering toward each other, the outer surfaces of which are pressed into engagement with the inner peripheral surface of the housing by the pressure of the gas pillow.

14 Claims, 2 Drawing Figures

HYDRAULICALLY OPERATED MINE PROP WITH SAFETY VALVE

BACKGROUND OF THE INVENTION

The present invention relates to a hydraulically operated mine prop, in which the end wall of the inner prop member bordering the fluid filled space of the outer prop member is provided with an overpressure safety valve of large flow-through cross-section and comprising a valve seat in communication with the fluid filled space of the outer prop member and a valve member axially movable between a closed position engaging the valve seat and an open position in which the fluid filled space of the outer prop member communicates through the valve seat with channels leading to the outside of the prop. The valve member is normally held in the closed position by a gas pillow under high pressure pressing the valve member against the valve seat.

In hydraulically operated mine props, an uncontrolled pressure build-up may occur in the fluid filled chamber of the prop in the event of a certain excessive loading of the prop, for instance during a rock burst or a sudden collapse of the mine roof supported by the prop. Such a pressure build-up may be caused by the relatively small cross-sectional flow-through area of the overpressure valve which is usually provided in order to protect the prop and by the inertia of the movable valve members which are unable to immediately reduce the pressure peaks occurring during rock bursts.

In order to avoid these disadvantages, special overpressure valves have been used which are provided with large flow-through cross-sections. However, such valves necessarily require high closing forces, which are further increased because such valves must generally be adjusted for closing forces which are basically higher than the closing forces acting on normal working valves. In principle, these high closing forces can be produced by mechanical springs. However, such springs require a large mounting space, which is usually not available in mine props of the type in question. Such mechanical spring elements have, therefore, been replaced with cushions of highly compressed macromolecular gases.

Gas cushions of this type have, however, a substantial disadvantage. Notwithstanding the fact that macromolecular gases are being used, these gases still have the tendency to diffuse gradually through the material of the seals, which seal the pressure chamber enclosing the gas cushion. Such a gas loss causes the compression of the gas cushion to decrease gradually. The function of the gas cushion thus ceases, with the result that the prop is no longer protected in the event of a sudden excessive loading. In order to meet the high safety requirements in underground mining, the over-pressure valves must, therefore, be taken out after a certain service life from the mine props and replaced by new valves. The therewith connected expenditure in time, personnel and material, is evidently rather high.

SUMMARY OF THE INVENTION

It is an object of the present invention to overcome the disadvantages of mine props provided with overpressure valves according to the prior art.

It is a further object of the present invention to provide a hydraulic mine prop with an overpressure valve having a large flow-through cross-section and which is, as regards the service life of the gas cushion effecting the closing force, substantially comparable to the service life of mechanical spring elements.

With these and other objects in view, which will become apparent as the description proceeds, the hydraulically operated mine prop includes an outer cylindrical prop member closed at one end and an inner prop member slidingly guided in the outer prop member between an expanded and a collapsed position and having an end wall spaced from and facing the closed end of the outer prop member and defining between the closed end and the end wall a closed space adapted to be filled with pressure fluid for expanding the mine prop, in which the end wall of the inner prop member is provided with an axial bore and passage means communicating at one end with the axial bore and at the other end with the outer atmosphere. The prop includes further an overpressure valve of large flow-through cross-section for discharging pressure fluid from the closed space when the prop is suddenly loaded with excessive force. The overpressure valve comprises a valve housing fluid tightly mounted in the axial bore in the end wall of the inner prop member and forming at one end thereof a valve seat communicating with the aforementioned closed space, a valve member axially movable in the valve housing between a closed position engaging the valve seat and an open position in which the closed space communicates with the passage means, and means constituted by a gas pillow of high compression for biasing the valve member to the closed position. The gas pillow is confined in a pressure space which is circumferentially delimited by the wall of the valve housing and at one end by the valve member and at the opposite end by a plug fixedly secured to the other end of the valve housing, in which the valve member and the plug have peripherally extending thin walled sealing lips projecting into the pressure space and being pressed by the gas pillow onto the wall of the gas housing. The valve member and the plug as well as the sealing lips thereon are formed from gas impermeable material, preferably metal.

The essence of the invention is therefore the sealing of the pressure chamber containing the highly compressed macromolecular gas cushion by elements which are gas impermeable. The pressure of the gas cushion may, for example, be in the region of 300 bar. The seal which prevents a slow seeping of the gas from the pressure space is obtained by the thin walled sealing lips, the outer periphery of which is pressed against the inner peripheral surface of the valve housing, to thus obtain a perfect seal of the pressure space.

According to an advantageous further development of the invention, the circular sealing lips of the valve member and of the plug have each an outer cylindrical surface abutting against the wall of the housing and a slender axial cross-section of triangular shape having a pointed free end. The sealing lips have thus a sufficient strength and the necessary elasticity in order to be pressed tightly at their outer periphery under the influence of the gas pressure against the inner surface of the valve housing to assure thereby the necessary sealing effect. With regard to the degree of slimness of the sealing lips, the ratio of the length thereof to the thickness at their root or base is preferably approximately 4:1.

As has been stressed before, the high pressure of the gas cushion insures that the slim sealing lips are satisfactorily pressed against the inner surface of the wall housing. However, in order to assure that, in the event of a lower pressure existing temporarily in the pressure space, the latter is still satisfactorily sealed, the invention provides also for sealing members of a material of limited elasticity arranged in front of the sealing lips on the pressure space side. Such material may for instance be a synthetic material of a rubber base. These sealing members have, however, only the task of insuring tightness in the case of low pressure, which may temporarily exist in the pressure space.

Preferably, the sealing member applied to the sealing lip of the valve member is substantially pot shaped and has an annular sealing edge projecting in axial direction beyond the sealing lip of the valve member and abutting against the wall of the valve housing. The cup-shaped sealing member can thus closely contact the inner contour of the sealing lip at that end face of the closing member which faces the pressure space, whereby the sealing edge of this sealing member seals the transition region between the sealing lip and the wall of the valve housing in the case of low pressure in the pressure space.

On the other hand, it is also advantageous to apply a sealing member of annular shape to the plug, having an annular sealing edge projecting in axial direction beyond the sealing lip of the plug and abutting against the wall of the valve housing. Such an annular sealing member may be of substantially V-shaped cross-section and be arranged in a groove formed between the inner surface of the sealing lip of the plug and the outer surface of a cylindrical member projecting centrally from the plug into the pressure space. It is therefore not necessary to secure the annular sealing member by additional means.

According to a further feature of the present invention the central cylindrical member projecting from the plug is provided with a central bore extending also through the plug and closed, at the end thereof distant from the pressure space, by a metal member. In this construction a coil compression spring is arranged in the aforementioned central bore, abutting with one end against the metal member closing the lower end of the bore and with the other end against a spring retainer abutting against the pot-shaped sealing member so that the latter is pressed by the spring against the valve member. The plate-shaped spring retainer may have a central projection extending into the coil compression spring to centralize thereby the latter on the spring container. The compression spring forms a safety member integrated in the hydraulic safety valve which presses the valve member thereof tightly against the valve seat, even if the gas pressure in the pressure space drops.

To assure that during a sudden opening of the overpressure valve neither the sealing lips on the valve member and the plug nor the sealing edges of the sealing members applied thereagainst come in contact with each other, the distance between the end face of the cylindrical member and the end face of the spring retainer is made smaller than the distance between the sealing edges of the sealing members. According to the present invention it is further advantageous that the valve member is made from a metal of small specific weight, such as for instance aluminum or an aluminum alloy. Due to this small specific weight the inertia of the valve member is greatly reduced.

In this connection it is also advantageous that the valve member may be provided with mass reducing recesses and/or restrictions. Such restrictions may be formed for instance by turned grooves in the circumference of the valve member.

According to the invention it may also be advantageous in certain cases to coat the circumferential slide face of the valve member at least partially with a film of friction reducing material, such as, for instance, polytetrafluoroethylene. At least partially coated means, in this context, that, if desired, the circumferential area of the sealing rim associated with the valve member may be coated with such a thin layer without the sealing effect being impaired thereby.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
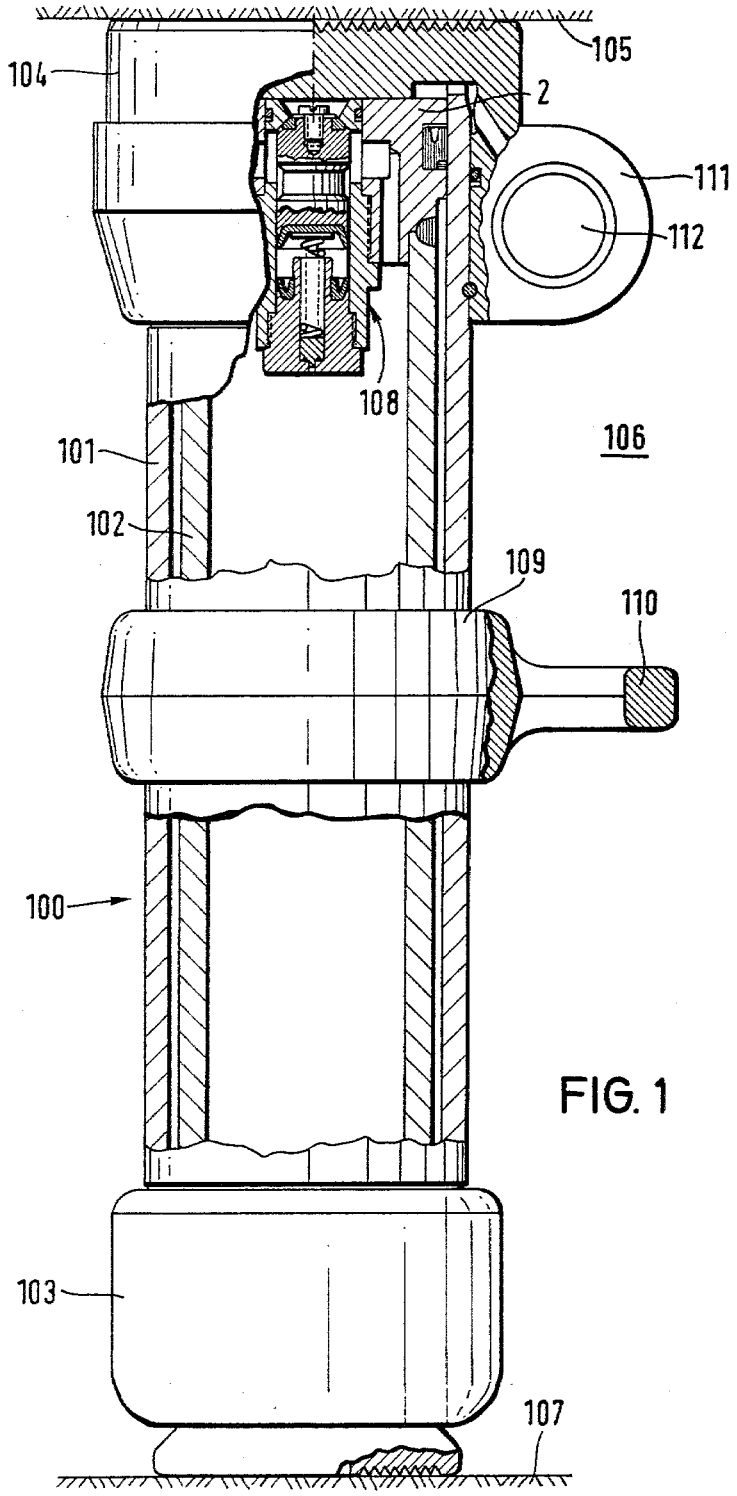
FIG. 1 schematically illustrates the overall construction of the prop according to the present invention provided with overpressure valves.

Referring now to the drawings, FIG. 1 show schematically the overall construction of the mine prop 100, according to the present invention.

As shown in FIG. 1, the prop 100 comprises a cylindrical outer member 101, a cylindrical inner member 102, a sole pad 103, connected with the inner member 102 and a mine roof supporting cap 104, connected with the outer member 101 and to be pressed by the prop 100 against the roof 105 of the mine gallery 106. 107 indicates the sole of the mine gallery 106. Further, the prop 100 comprises an overpressure valve 108, arranged in the end face 2 of the inner prop member 102, and a handling 109 with a handhold 110. 111 indicates a casing for a prop filling valve 112.

Figure 2:
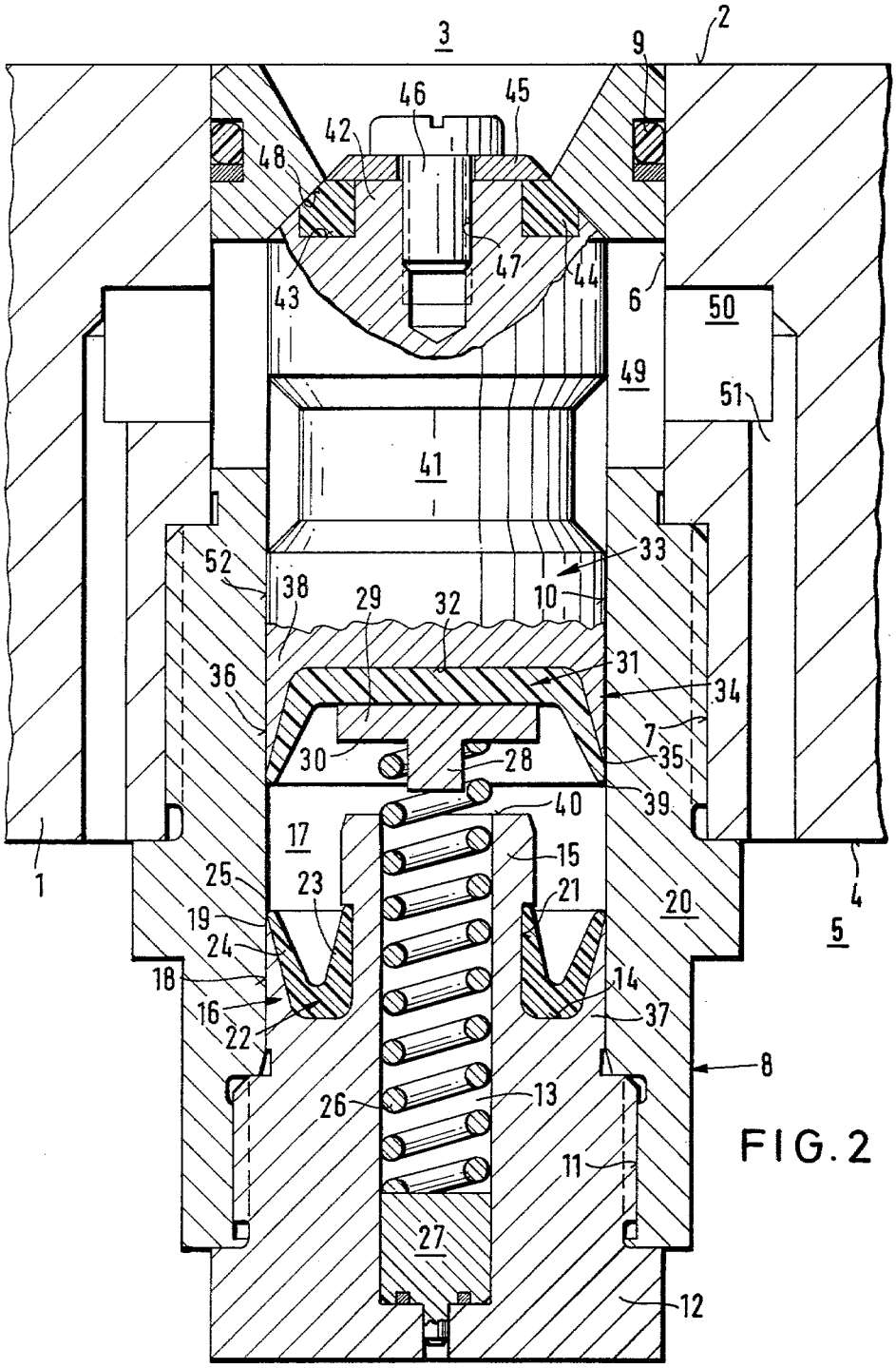
FIG. 2 is an axial cross-section through part of the inner member of the prop and the overpressure valve secured thereto.

As shown in FIG. 2, the end wall 1 of the inner prop member 102 has an end face 2 which borders the working chamber 3 of the external prop member adapted to be filled with a hydraulic pressure medium for expanding the prop, whereas the opposite face 4 of the end wall 1 borders the interior of the inner prop member 102 which is in communication with the atmosphere.

The end wall 1 is provided with a central stepped bore therethrough which has a smooth cylindrical section 6 and a threaded section 7. A housing 8 of an overpressure valve is screwed into threaded section 7. The housing 8 is sealed from the working chamber 3 by means of a sealing ring 9.

The valve housing 8 is provided with a longitudinally extending central bore 10 having at the lower end a threaded portion 11 into which a metallic plug 12 is screwed. A central bore 13 is provided in the plug 12 extending along the axis of the latter and through a cylindrical member 15 projecting upwardly from the end face 14 of the plug. It can also be seen that, on the circumference of the plug 12 there is provided an annular sealing lip 16, which projects into a pressure chamber or pressure space 17 which is filled with a macromolecular gas under high pressure. The sealing lip 16 has a slim, thin walled substantially triangular cross-section having a cylindrical outer surface 18. The metallic sealing lip 16, having a pointed end portion 19, is pressed by the pressure of the gas cushion against the surface defining the longitudinal bore 10 extending through the housing 8. An annular groove 21 is formed between the inner surface of the sealing lip 16 and the outer peripheral surface of the cylindrical member 15, into which a sealing member 22 is fitted. The sealing member 22 which is formed of a synthetic material with a rubber base and which is of limited resiliency, has a substantially V-shaped cross-section; the legs 23 and 24 thereof taper to pointed end portions. The sealing edge 25 of the leg 24 projects axially beyond the sharp edge 19 of the sealing lip 16 and tightly abuts against the surface defining the bore 10.

A coil compression spring 26 is located in the bore 13 abutting with one end thereof against a metallic abutment 27 which is gas-and pressure-tightly inserted into the lower end of the bore 13 to close this lower end. This metallic abutment member 27 can also be constructed as a one-way valve. The coil compression sping 26 surrounds with its other end a central projection 28 of a plate-shaped spring retainer 29 and abuts against the end face 30 of the latter which is directed toward the pressure space 17. The spring retainer 29 abuts with its opposite face against a substantially pot-shaped sealing member 31 formed from a limited flexible plastic material. The pot-shaped sealing member 31 thus tightly engages the lower end face 32 of the valve member 33, which is axially movable in the bore 10 of the valve housing 8.

An annular sealing lip 34 projects from the periphery of the end face 32 of the valve member 33 into the pressure space 17 and the sealing lip 34 has, similar to the sealing lip 16 of the plug 12, a slender triangular axial cross-section tapering towards the pressure space 17 and ending in a substantially sharp edge 35. The sealing lip 34 abuts with its outer peripheral surface 36 under the pressure of the gas pillow in the pressure space 17 tightly against the surface defining the bore 10. The relationship of the axial length of the sealing lips 16 and 34 to the width thereof in the region of the root or base 37, respectively 38, is about 4:1. It will be also seen from FIG. 2, that the sealing edge 39 of the sealing member 38 is at the side of the pressure space located ahead of the sharp edge 35 of the sealing lip 34 and abuts against the surface of the bore 10.

The distance of the end face 40 of the cylindrical member 50 from the end face 30 of the spring retainer 29 is smaller than the distance between the sealing edges 25 and 39 of the sealing members 22 and 31.

The valve member 33 is provided in a region between the opposite ends thereof with a material-and thus weight-reducing annular recess 41, extending from the peripheral surface of the valve member 33 into the latter and the valve member 33 has a frustoconical end portion 42 provided with an annular groove 43 in which a sealing ring 44 is fitted. The sealing ring 44 is retained in the groove 43 by means of a disk 45 which is secured in position by means of a screw 46. The screw 46 is threaded in a corresponding threaded bore 47 in the valve member 33. The sealing ring 44 abuts in the closed position of the valve member 33 tightly against a conical valve seat 48 formed in the end of the valve housing 8 adjacent to the working space 3 of the outer prop member. The valve housing 8 is formed below the valve seat 48 with cutouts 49 of large cross-section which communicate with channels 50 and 51 provided in the end wall 1 of the inner prop member and leading into the interior of the latter and thus to the atmosphere.

When an excessive load acts on the prop so that the fluid pressure in the working chamber 3 of the latter is increased, the valve members 33 will be moved to the open position compressing the gas pillow in the space 17 so that hydraulic fluid in the working chamber 3 may escape to partially collapse the prop.

The bore 47 accommodating the screw 46 may be extended beyond the length required for screwing in the screw in order to further reduce the mass of the closing member 33. The valve member 33 is preferably made of aluminum or an aluminum alloy or any metal having a comparatively low specific weight. The peripheral sliding face 52 of the valve member 33 may be coated, if necessary, with a thin film of a friction reducing material, for instance of polytetrafluoroethylene. This thin film may also be extended to the pointed portion 35 of the sealing lip 34.

It will be understood that each of the elements described above, or two or more together, may also find a useful application in other types of hydraulically operated mine props differing from the types described above.

While the invention has been illustrated and described as embodied in a hydraulically operated mine prop provided with an overpressure valve, it is not intended to be limited to the details shown, since various modificiations and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

That is claimed as new and desired to be protected by Letters Patent is set forth in the appended claims:

1. A hydraulically operated mine prop having an outer cylindrical prop member closed at one end and an inner prop member slidingly guided in the outer prop member between an expanded and a collapsed position and having an end wall spaced from and facing said closed end and definging between said closed end and said end wall a closed working chamber adapted to be filled with pressure fluid for expanding the mine prop, said end wall of said inner prop member being provided with an axial bore and passage means communicating at one end with said axial bore and at the other end with the outer atmosphere; and an overpressure valve of large flow-through cross-section for discharging pressure fluid from said working chamber when said prop is suddenly loaded with excessive forces, said overpressure valve comprising a valve housing fluid-tightly mounted in said axial bore and forming at one end thereof a valve seat communicating with said working chamber, a valve member axially movable in said valve housing between a closed position engaging said valve seat and an open position in which said working chamber communicates with said passage means, and means constituted by a gas pillow of high compression for biasing said valve member to said closed position, said gas pillow being confined in a pressure space which is circumferentially delimited by the wall of said valve housing and at one end by said valve member and at the opposite end by a plug fixedly secured to the other end of said valve housing, said valve member and said plug having peripherally extending thin-walled sealing lips projecting into said pressure space and being pressed by said gas pillow onto the wall of said valve housing, said valve member and said plug as well as the sealing lips thereon are formed from gas impermeable material.

2. A mine prop as defined in claim 1, wherein said valve member and said plug as well as the sealing lips thereon are formed from metal.

3. A mine prop as defined in claim 2, wherein said sealing lips have each an outer cylindrical surface abutting against the inner peripheral surface of the housing wall and a slender axial cross-section of triangular shape having a pointed free end.

4. A mine prop as defined in claim 3, wherein the relationship of the length of each sealing lip to the width at the root thereof is about 4:1.

5. A mine prop as defined in claim 2, and including a sealing member of a material of limited elasticity for each of said sealing lips and applied to the surfaces of the latter facing said pressure space.

6. A mine prop as defined in claim 5, wherein the sealing member applied to the sealing lip of the valve member is substantially pot-shaped and has an annular sealing edge projecting in axial direction beyond the sealing lip of the valve member and abutting against the peripheral surface of the wall of the valve housing.

7. A mine prop as defined in claim 6, wherein the sealing member applied to said plug is an annular sealing member having an annular sealing edge projecting in axial direction beyond the sealing lip of the plug and abutting against the inner peripheral surface of the wall of the valve housing.

8. A mine prop as defined in claim 7, and including a central cylindrical member projecting from said plug into said pressure space and forming with said sealing lip of said plug an annular groove in which said sealing member for said plug is located.

9. A mine prop as defined in claim 8, wherein said central cylindrical member is provided with a central bore extending also through said plug, and including a metal member closing said bore at the end thereof distant from said pressure space, a spring retainer abutting against said pot-shaped sealing member and a compression spring in said central bore abutting with opposite ends against said metal member and said spring retainer and pressing said pot-shaped sealing member against said valve member.

10. A mine prop as defined in claim 9, wherein the distance between the free end face of said cylindrical member and the face of said spring retainer directed towards said end face is smaller than the distance between the sealing edges of the sealing members.

11. A mine prop as defined in claim 1, wherein said valve member is formed from metal of small specific weight.

12. A mine prop as defined in claim 1, wherein said valve member is provided with weight-reducing cutouts.

13. A mine prop as defined in claim 1, and including a film of friction-reducing material applied onto at least part of the outer peripheral surface of said valve member.

14. A mine prop as defined in claim 13, wherein said friction-reducing material is polytetrafluoroethylene.

* * * * *